US006357210B1

(12) United States Patent
Wetter

(10) Patent No.: US 6,357,210 B1
(45) Date of Patent: Mar. 19, 2002

(54) APPARATUS FOR FILING CASES WITH BAG CONTAINING DEFORMABLE PRODUCTS

(75) Inventor: Bruno Wetter, Cote St. Luc (CA)

(73) Assignee: Glopak Inc., Quebec (CA)

( * ) Notice: Subject to any disclaimer, the term of this patent is extended or adjusted under 35 U.S.C. 154(b) by 0 days.

(21) Appl. No.: 09/457,923

(22) Filed: Dec. 9, 1999

(51) Int. Cl.[7] ..... B65B 63/02

(52) U.S. Cl. ..... 53/436; 53/448; 53/459; 53/493; 53/537; 53/539

(58) Field of Search ..... 53/250, 259, 244, 53/151, 534, 535, 536, 540, 384.1, 469, 539, 529, 449, 475, 263, 260

(56) References Cited

U.S. PATENT DOCUMENTS 4,172,349 A * 10/1979 Lipes ..... 53/459
4,398,383 A * 8/1983 Prakken ..... 53/537
5,150,563 A * 9/1992 Hartness ..... 53/539
5,765,337 A * 6/1998 Lodewegen et al. ..... 53/493
5,813,196 A * 9/1998 Page et al. ..... 53/448

* cited by examiner

*Primary Examiner*—Peter Vo
*Assistant Examiner*—Thanh Truong
(74) *Attorney, Agent, or Firm*—Carter & Schnealer, P.A.

(57) ABSTRACT

A case loading machine and method of operation is described for positioning at least two flexible bags, having an unstable product therein, in a case and in side-by-side contact with one another. A case engaging and displacement mechanism is positionable inside a case from an open top end of the case whereby to divide the case into compartments of predetermined size. The mechanism holds the case at a loading position with one of the compartments aligned at a bag receiving position. A bag engaging and transfer mechanism engages one of the bags from a bag filling position and transfers it into the aligned compartment. The bag engaging and transfer mechanism is provided with a compression compartment to compress the flexible bag and displace the unstable product therein whereby the bag is sized to enter into the aligned compartment. The case is then displaced to align another compartment at the loading position to receive a further bag. Once a case is filled with a predetermined number of bags, a new case is engaged and the loading process repeats itself.

14 Claims, 9 Drawing Sheets

APPARATUS FOR FILING CASES WITH BAG CONTAINING DEFORMABLE PRODUCTS

TECHNICAL FIELD

The present invention relates to a case loading machine and method of operation for positioning at least two flexible bags, having an unstable product therein, in a case and in side-by-side contact with one another.

BACKGROUND ART

Various machines are known for casing unstable products that are contained in bags. However, most of these machines and processes simply drop predetermined number of packages in an open top end of a box and the box is sized to accept predetermined quantities of these products which are released in an orderly or disorderly fashion. Many known case loading machines also utilize vacuum suction cups to engage, displace and position products within a case. A typical example of machines for packaging flexible packages is described in U.S. Pat. No. 5,044,143.

When handling flexible bags which contain an unstable product therein, such as milk pouches, the bag deforms itself by the weight of the liquid therein and the bottom part of the bag expands. This poses problems when a predetermined number of bags need to be positioned within a case in an orderly fashion whereby the bags are all visible from the open top end of the case while at the same time the bags occupy a substantial portion of the volume of the case. Heretofore, these products have been packaged in boxes or cases in a disorderly fashion stacked one on top of each other. Consequently, the bag at the bottom of the box bears the weight of all the other bags on top of it. This often causes the bottom bags to burst during manipulation of the case or when in transit in a vehicle, particularly when the vehicle is subjected to rough road conditions imparting movement and shocks to the cases. Not only does the bag at the bottom of the case burst, but the liquid products within the bags will often soil bags in adjacent cases depending on how these cases are transported and disposed in the vehicle. The result of this is very costly and time-consuming to rectify.

SUMMARY OF INVENTION

It is a feature of the present invention to provide a case loading machine and method of operation which is capable of positioning at least two flexible bags, having an unstable product therein, in a case and in side-by-side contact with one another while occupying a substantial volume of the case and machine and method substantially overcomes the above-mentioned disadvantages of the prior art.

According to the above feature, from a broad aspect, the present invention provides a case loading machine for positioning at least two flexible bags, having an unstable product therein, in a case and in side-by-side contact with one another. The machine comprises case engaging and displacement means having at least one rigid division wall plate positionable inside the case from an open top end of the case to divide the case into two or more compartments of predetermined size. The case engaging and displacement means holds the case at a loading position with one of the compartments aligned at a bag receiving position. Bag engaging and transfer means is provided for engaging one of the bags, from a bag filling position, and transferring same in the said one compartments aligned at the bag receiving position. The bag engaging and transfer means has compression means to compress the flexible bag and displace the unstable product therein whereby the bag is sized to enter into the aligned one of the compartments. The case engaging and displacement means displaces the case to align the other of the two compartments, sequentially, at the loading position to each receive a further bag from the bag engaging and transfer means. Means is provided to feed another case to the case engaging and displacement means.

According to a still further broad aspect of the present invention there is provided a method of positioning two or more flexible bags, having an unstable product therein, in a case and in side-by-side contact with one another. The method comprises the steps of engaging a case at a case loading position from an open top end thereof and segmenting the case into compartments. The method also includes displacing the case to position the compartments, in sequence, at a bag receiving position. The filled bag with the unstable product therein is displaced to a bag transferring means. The bag with the unstable product is then compressed in the bag transferring means to size the bag to enter into the compartment positioned at the bag receiving position. The case is then displaced to load all of the compartments in sequence at the bag receiving position. The case, filled with a predetermined quantity of the bags is then released and another case is engaged.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
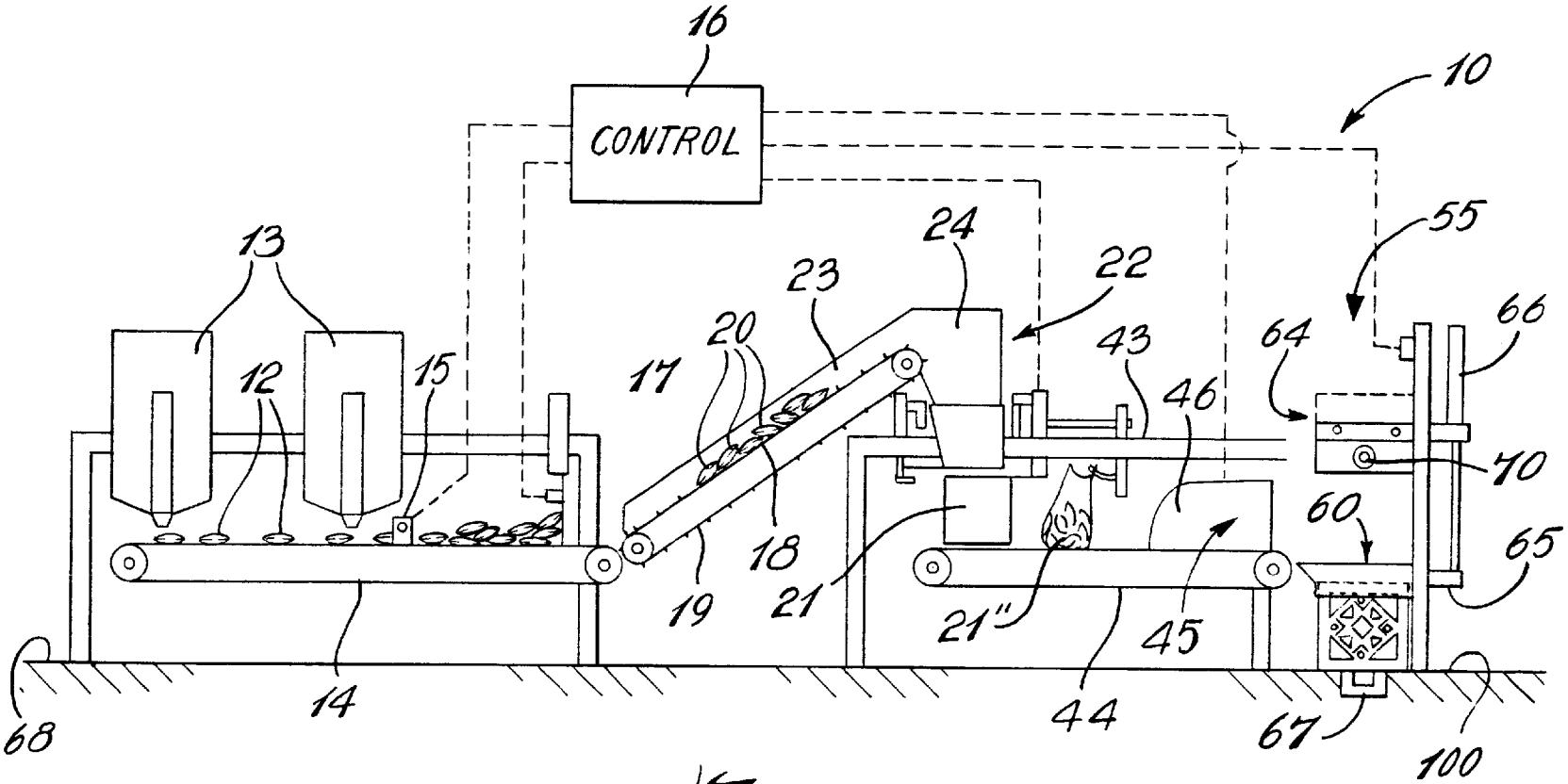
FIG. 1 is a simplified side view of the case loading machine of the present invention.

Referring now to the drawings, and more particularly to FIG. 1, there is shown generally at 10 the case loading machine of the present invention associated with a feed conveyor and bag filling machine 22. More specifically, the case loading machine 10 as herein described is utilized for placing plastic bags 21, containing a plurality of small liquid pouches 12, into a case 11 and in side-by-side relationship therein while occupying a substantial portion of the volume of the case.

As shown in FIG. 1, small pouches 12 are formed and filled with a liquid, such as milk, by two Thimonier machines 13 and the pouches 12 are released on a conveyor 14 which forms part of a feed conveyor assembly. A counting device 15 is associated with the conveyor 14 to count the pouches passing by the counter and feeds signals to a controller 16 which counts these. A piston actuated stop gate 17 separates batches 18 of pouches 12 with each batch having a predetermined quantity of pouches and releases the pouches that have been momentarily stopped to a second inclined conveyor 19 which is provided with pusher bars 20 to convey the batches 18 up the inclined conveyor 19. After a predetermined number of pouches are released on the inclined conveyor, past the stop gate 17, the stop gate is actuated to start accumulating pouches for a short period of time only sufficient to effectuate a bagging cycle, as will be described later. Accordingly, the stop gate may accumulate only a small portion of the pouches of a batch to separate the batches from one another on their way to the bag filling station 22.

The inclined conveys has side plates 23 to prevent the pouches from falling off the conveyor 19. It also has a chute 24 at a discharge end of the conveyor 19 to guide the pouches into the open top end 25 of a bag 21 held under the chute, as illustrated in FIG. 3B.

Figure 3A:
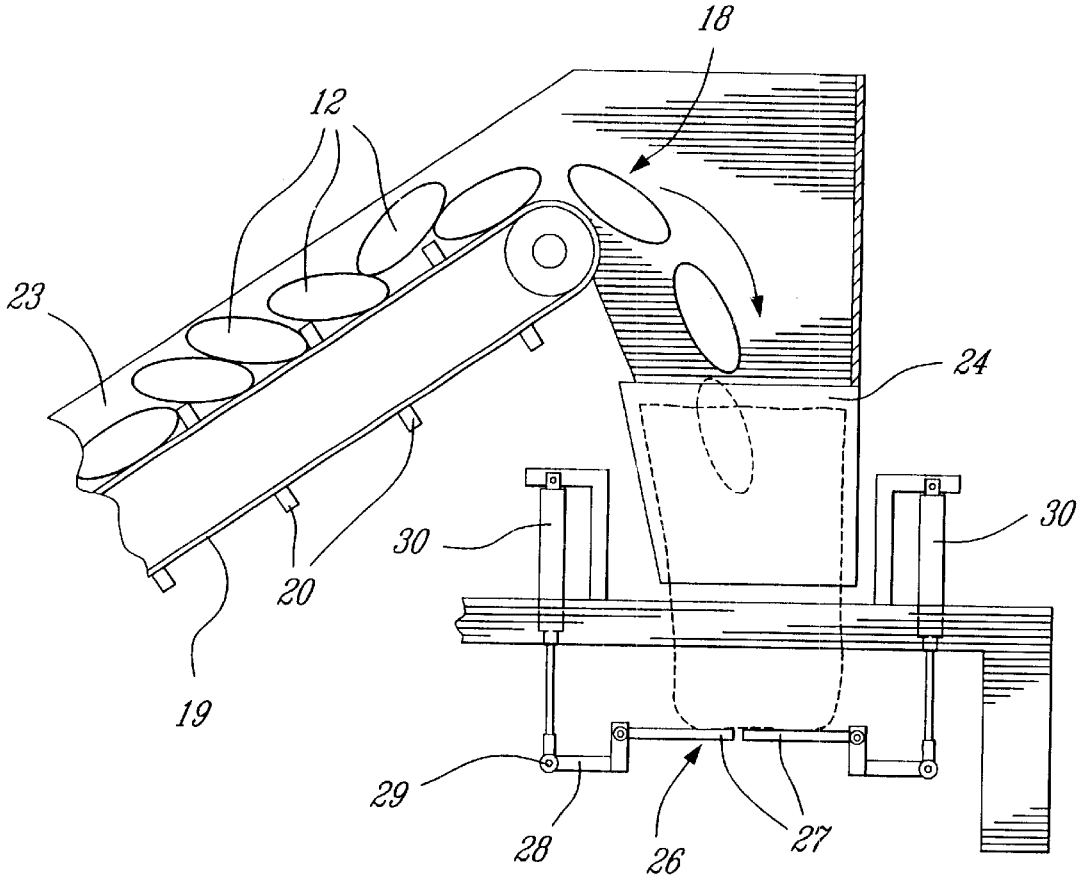
FIG. 3*a* is a fragmented side view of the bag loading chute and the top end of the inclined conveyor.
Figure 3B:
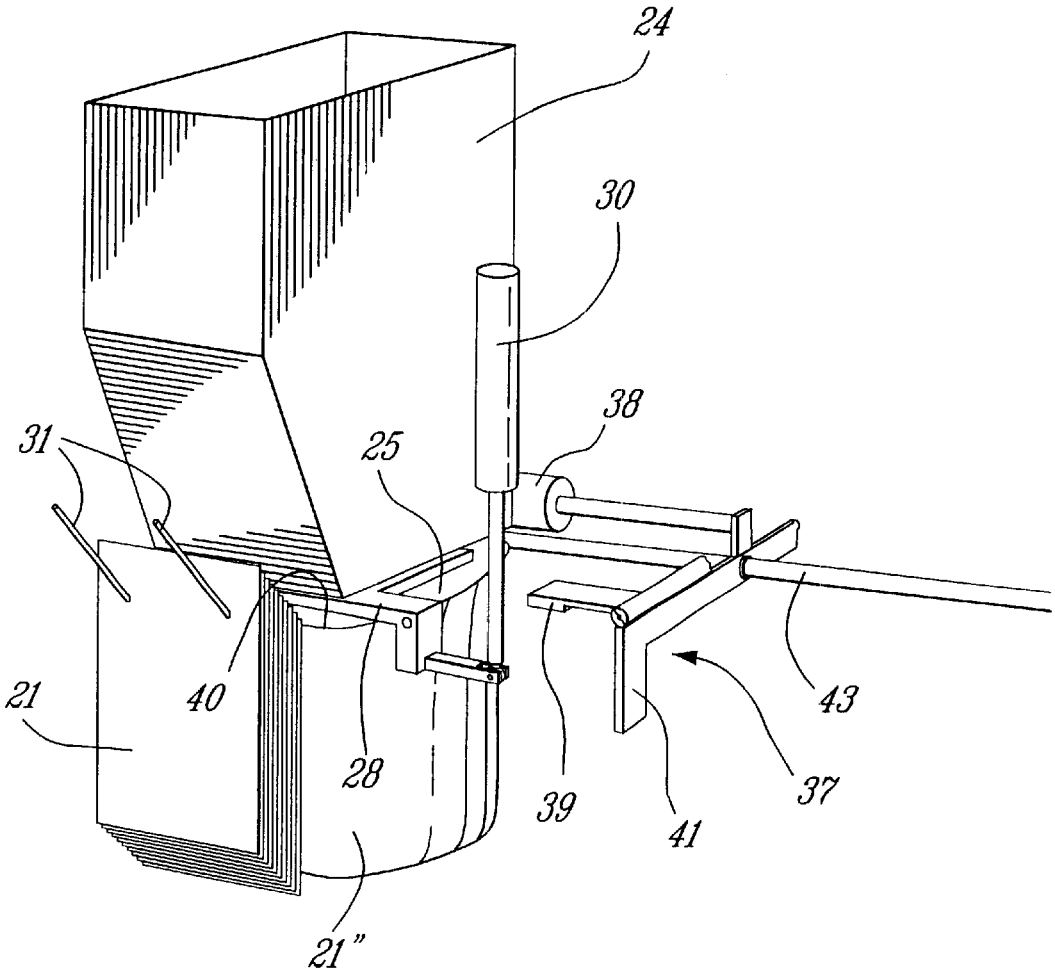
FIG. 3*b* is a fragmented perspective view of a bag being loaded with pouches having an unstable product therein.

As shown in FIGS. 3*a,* 3*b,* 3*d* and 3*e,* the chute 24 is provided with a piston operated bottom trap wall assembly 26 which consists of a pair of hinged plates 27 which are secured to a linkage 28 to cause the plates 27 to pivot on their pivot 29 when respective pistons 30 are operated. The pistons 30 are operated by control signals from the controller 16. The hinge plates 27 close after a batch has been discharged so as to permit the filled bag 21" as shown in FIGS. 1 and 3*b,* to be removed from under the chute 24 and another bag 21 from the series of bags 21' supported on wicket pins 31 to be opened and secured under the trap wall, see FIG. 3*c.* By that time, the chute 24 has accumulated leading ones of the pouches 12 of the next batch 18 of pouches and when the bag is in its open position, a signal is sent to the controller 16 and the trap door assembly is actuated to open the hinge plates 27. The trap door remains open with the pouches being dumped into the chute and directly into the open bag 21' held thereunder until the last pouch of the next batch is discharged. The trap door assembly then closes and the cycle repeats itself.

Figure 3C:
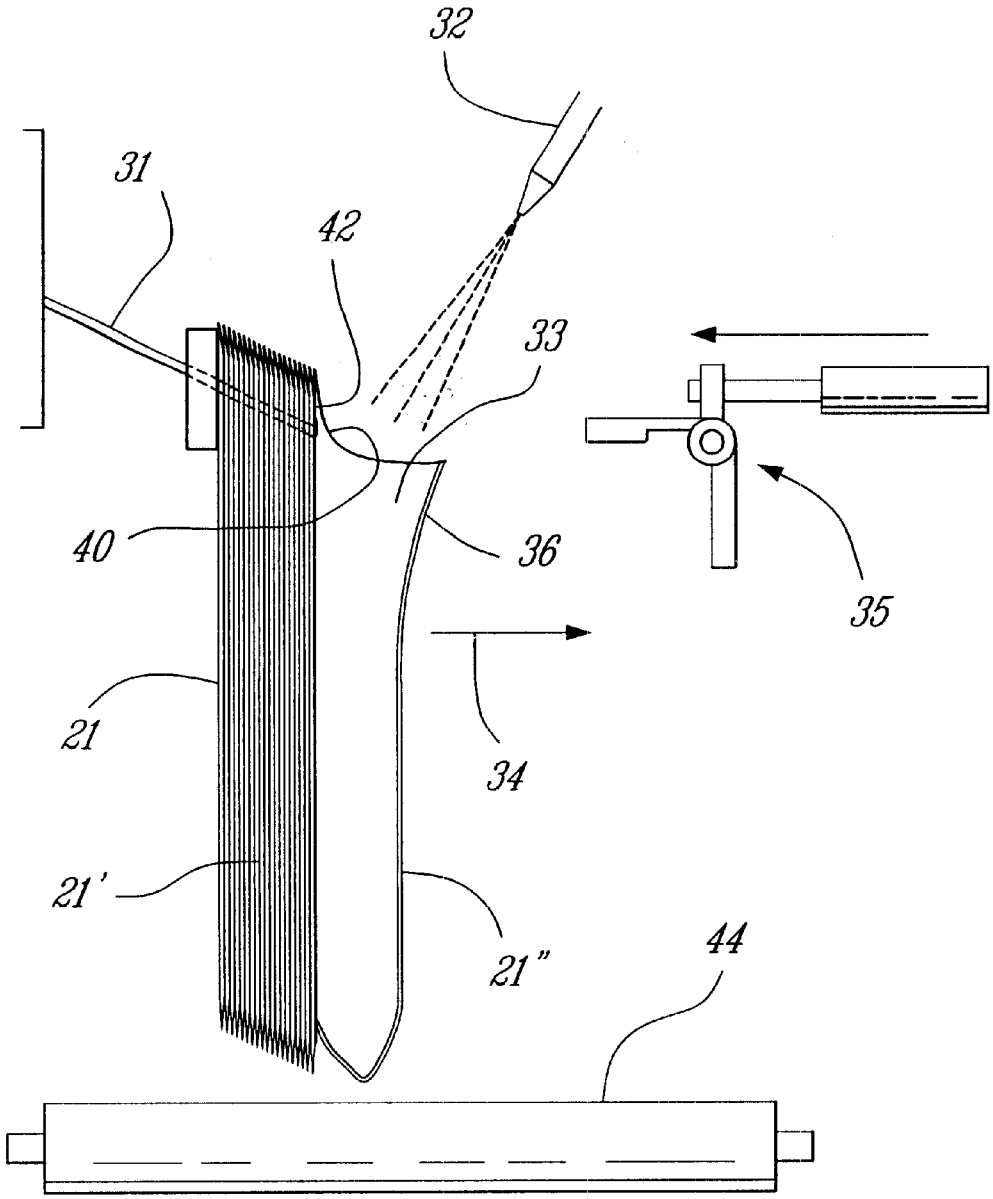
FIG. 3*c* is a simplified side view showing how a bag is opened.
Figure 3D:
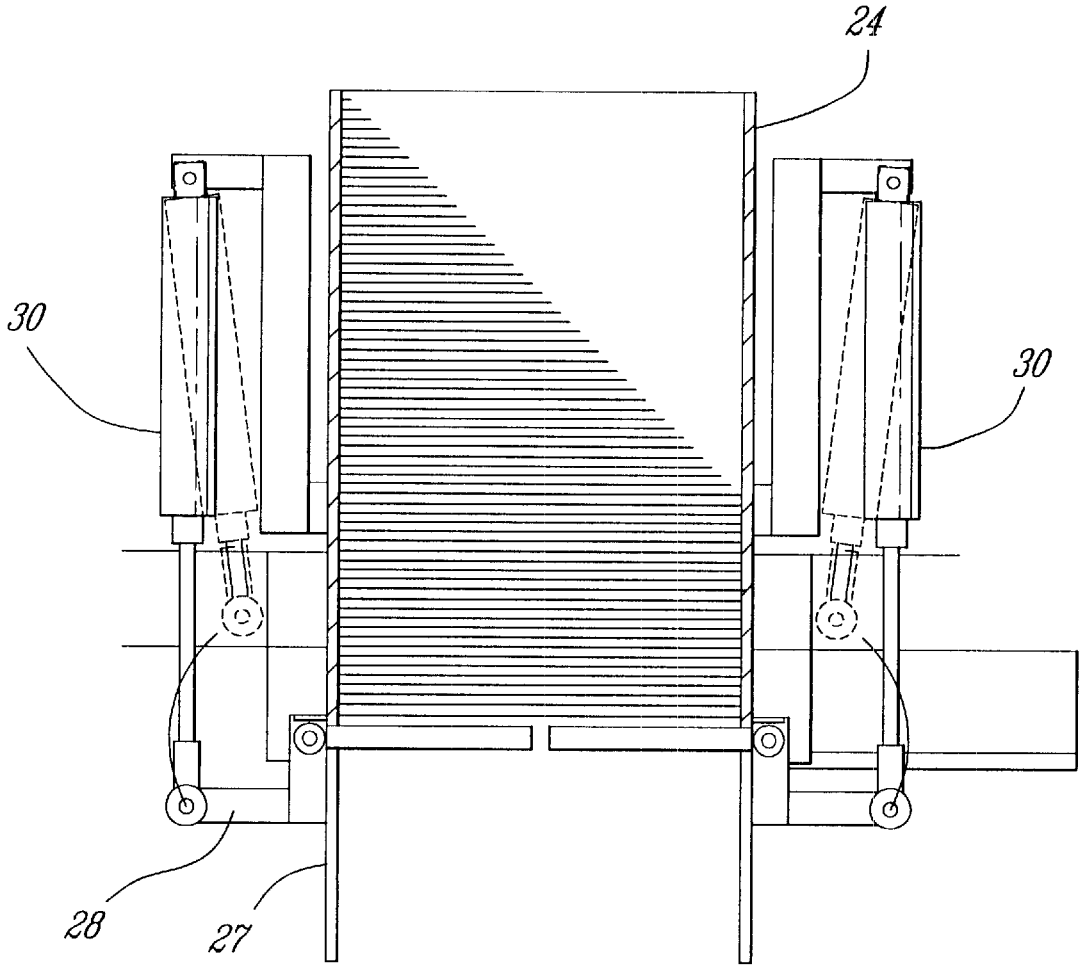
FIG. 3*d* is an end view of the chute and the trap door linkage assembly.
Figure 3E:
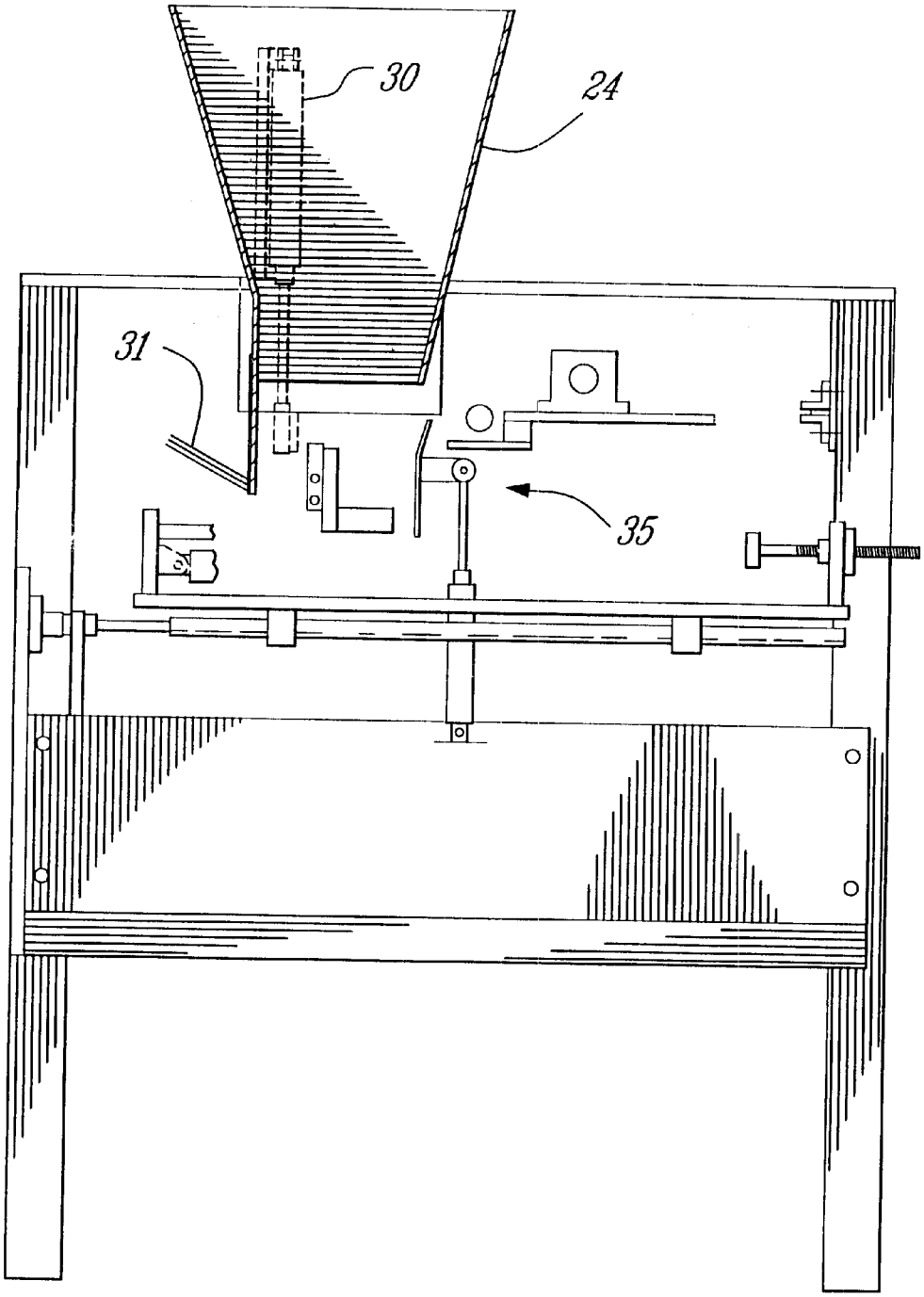
FIG. 3*e* is a side view of FIG. 3*d* showing the bag engaging and transfer mechanism.

FIG. 3*c* illustrates the bag opening means and it is of a type well known in the art. It consists of a bag supply formed by a plurality of collapsed bags 21' held on wicket pins 31 and these bags are maintained in juxtaposition. A first one of these bags, filled bag 21", is opened by directing an air jet 32 in the area of the mouth opening 33 thereof to cause the front wall of the bag to move out in the direction of arrow 34. A bag clamp mechanism 35 moves in to clamp the top edge portion 36 of the filled bag 21" and pull it open in the direction of arrow 34. A side transfer clamp assembly 37, as shown in FIG. 3*b,* is operated by a piston 38 and moves in towards the filled bag 21" with the clamp finger 39 in an open position, as shown. It moves over the top side edge 40 of the open filled bag 21" and then clamps a side wall of the bag onto the backing plate 41 to positively engage the side wall of the bag. The bag is then filled with the product and after it is filled the piston 38 is actuated to transfer the filled bag from under the chute 24 with the aid of a transfer conveyor 44. As described hereinabove, the trap wall 26 is now closed and the next bag is opened and the cycle repeats itself.

When the bag engaging and transfer clamp assembly 37 is moved away from of the bag filling station 22, it rips the filled bag attaching panel 42 from the wicket pins 31. The piston 38 has a piston stroke sufficient to move the side transfer clamp assembly 37 along the guide rails 43 (see FIG. 4), and it moves at the same speed as a transfer conveyor 44 located under the bags 21 so that the filled bag once ripped off its wicket pin is immediately supported on the transfer conveyor and not subjected to a drag force.

Figure 4:
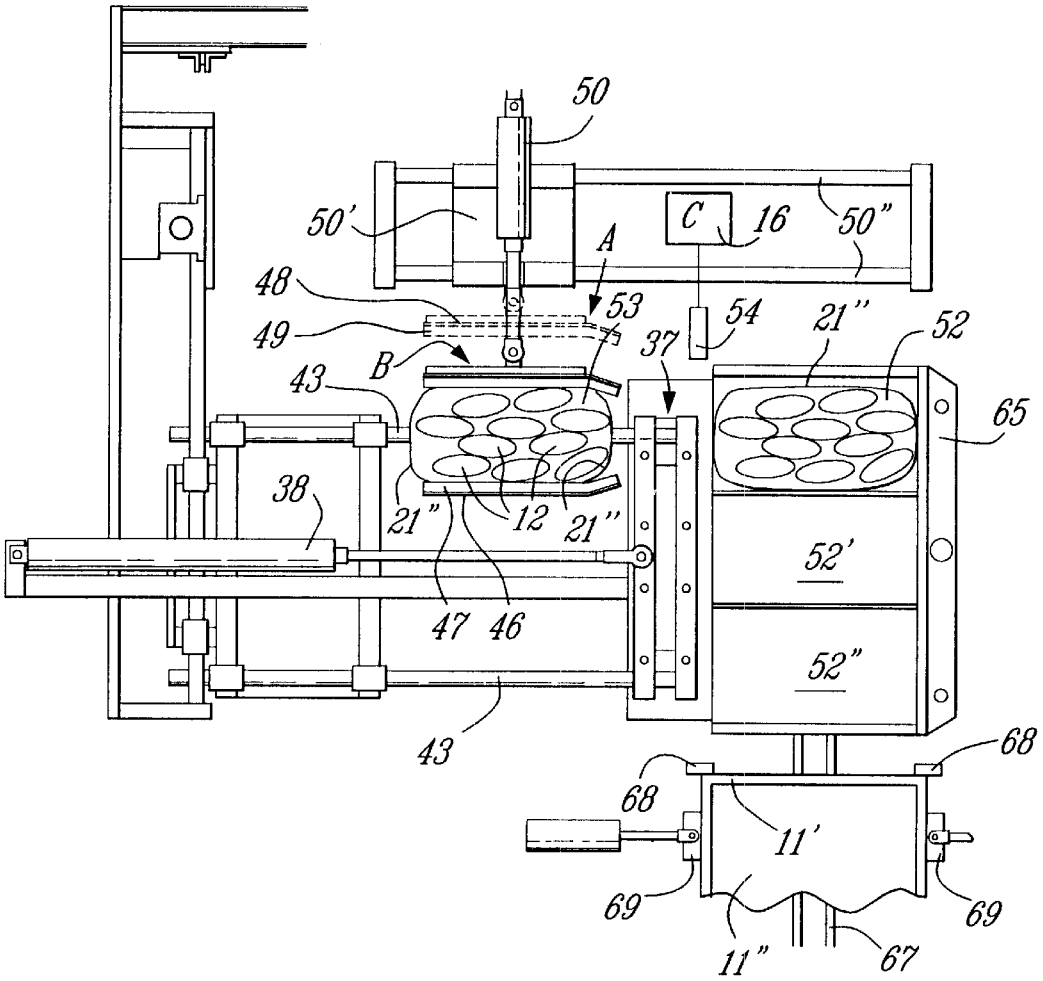
FIG. 4 is a top view of the bag engaging and transfer mechanism and the case positioning system.

The side transfer clamp assembly 37 retain the filled bag 21" until it is transferred between a pair of spaced-bag engaging and compression transfer plates 45, as shown in FIG. 4. Once the filled bag 21" is positioned between the bag engaging and compression transfer plates 45, the transfer conveyor 44 is arrested. As shown, the bag engaging and compression transfer plate assembly is comprised by a stationary vertical plate 46 having an inturned support lower ledge 47 and a displaceable vertical plate 48 also provided with a lower support inturned ledge 49. The displaceable plate 48 is displaceable to and away from the stationary plate 46 by a piston 50 whose operation is again controlled by the controller circuit 16. The plate 48 is displaced in substantially planar parallel relationship to and away from the stationary plate 46 from a bag receiving position "A", where the plate 48 is further away, and then to a compression position "B" where the plates are spaced closer to one another to squeeze or compress and support the filled bag 21", such as the bag shown at 51 in FIG. 4, in a compressed state. This sizes the filled bag to enter into the compartment 52 of the case 11 positioned in alignment at the bag receiving position 53. The plates 46 and 48 are connected to the frame 50' which is displaceable on guide rod 50 to position the plates with a filled bag 51 compressed therebetween over the compartment 52. The plate 48 is then retracted by the piston 50 to unload the compressed bag 51 in the compartment 52 and the frame 50' is retracted to its bag receiving position, as shown in FIG. 4. A photocell 54 detects the transfer of the filled bag 21" into the compartment 52 of the case 11 and feeds a signal to the controller 16. The controller 16 then causes a case engaging and displacement mechanism 55, as shown in FIG. 1, to operate.

Figure 2:
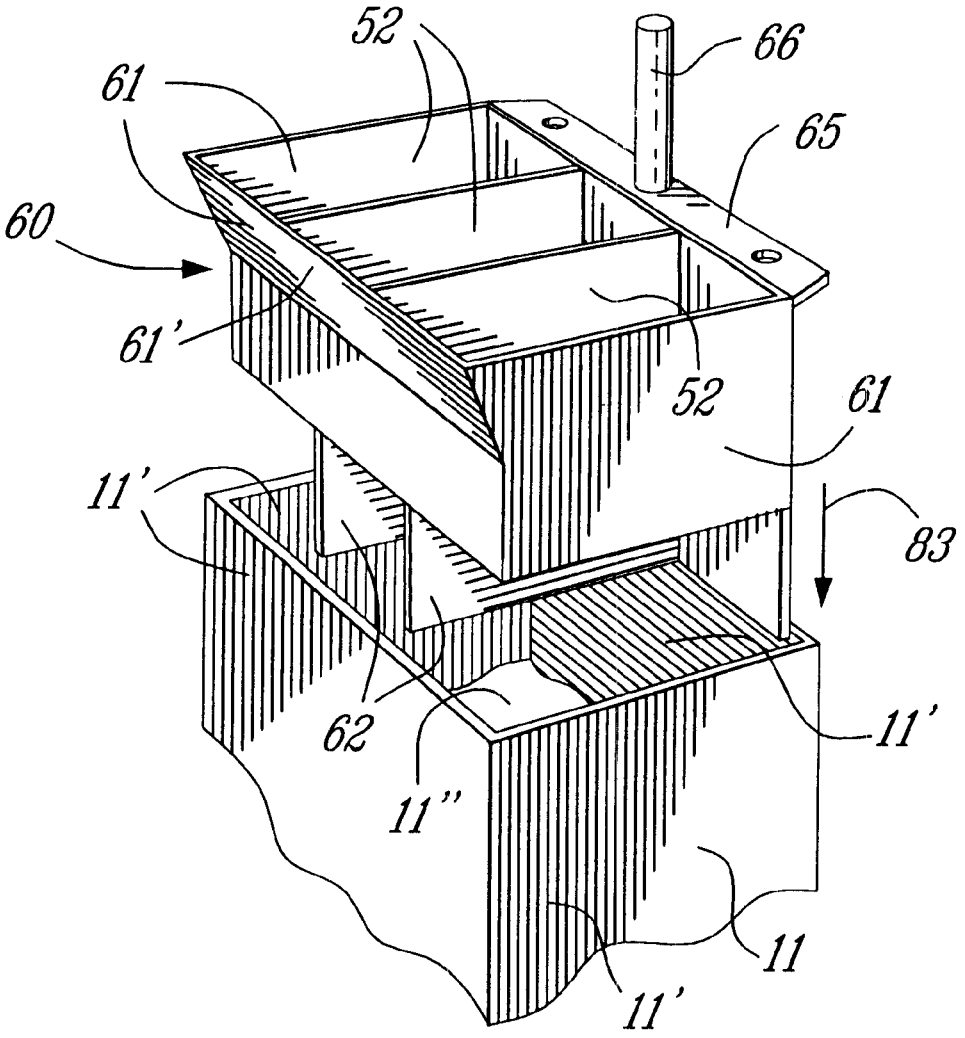
FIG. 2 is a perspective view of the case engaging and displacement mechanism incorporating the compartment division walls.

The description of the case engaging and displacement mechanism 55 will now be described with more specific reference to FIGS. 1, 2, 4 and 5. As shown in FIG. 2, it consists essentially of a rectangular case engaging frame 60, which is dimensioned to fit inside the case 11, and in close fit adjacent opposed side walls 11' of the case. The case engaging frame 60 is constituted by opposed top parallel flange walls 61 and two division wall plates 62. The division wall plates 62 extend below the top flange walls 61 and are dimensioned to fit inside the case close to the bottom wall 11" of the case. The top flange walls 61 have a front flared top portion 61' to guide the compressed bag within the compartments 52 which are formed between the top flange walls and the division wall plates. Of course, depending on the sizes of the bags and the sizes of the cases, there may be only one division wall to form two of the compartments 52 or there could be several division walls 62 to form may compartments 52.

Figure 5:
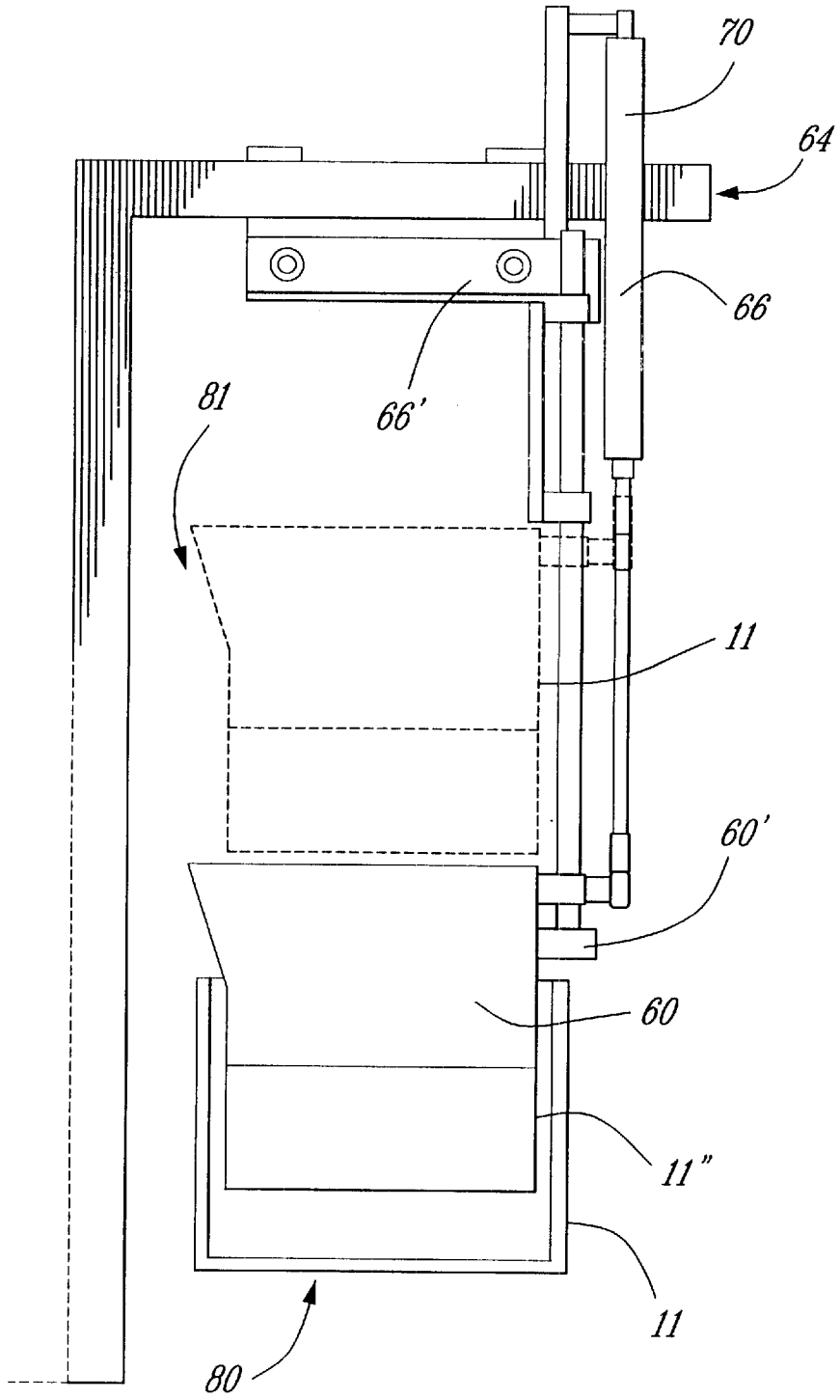
FIG. 5 is a fragmented simplified top view showing the construction of the case engaging and displacement mechanism.

The case engaging frame 60 constitutes a case engaging and displacement means by being secured to a piston actuated indexing frame 64. As shown in FIG. 5, the case engaging frame 60 is connected to a vertical displaceable support frame 61' which is actuated by a piston 66 which is controlled by the control circuit 16 to cause the frame 65 to move up and down to engage and to disengage from a case 11. The vertical displaceable support frame 61' is mounted on an indexing frame 66' capable of displacing the case engaging frame laterally at right angles to its vertical displacement. This permits the displacement of the case engaging frame 60, when engaged with the case, and consequently the case secured thereto to be displaced adjacent the loading position 63 so that each compartment 52 of the case defined by the division plates 62 can be displaced, in sequence, adjacent the loading or bag receiving position 53 to receive a compressed filled bag 51 with pouches therein and to guide the bag inside the case. The case engaging frame 60 remains in the case until all three compartments 52 have been filled. After a case is fully loaded, the case engaging frame 60 is retracted upwardly and the case is released on its transport conveyor 67. The conveyor 67 is a surface conveyor mounted inside the floor surface 100 and such are well known in the art. Accordingly, cases are fed along this transport conveyor to the case loading machine of the present invention where they are filled and then conveyed away to another station for loading into transport vehicles.

As shown in FIG. 4, as the cases are conveyed to the machine 10 of the present invention, the cases 11 are arrested by arresting arms 68 to hold the case at a feed position 80 adjacent the loading station 81, see FIG. 5. A pair of clamps 69 assures the exact positioning of the case 11 to permit the case engaging frame 60 to be moved thereover and lowered inside the case, as shown in FIG. 2 by arrow 83. The clamps 69 engage the opposed side walls 11' of the case 11 and release the case once the case engaging frame 60 is in an engaged position. This is controlled by the controller circuit 16. The piston actuated arresting arms 68 are then withdrawn and repositioned to receive the next case at the feed position. The piston 70 of the indexing frame is then actuated by the controller 16 to position the first compartment 52 at the loading position, see FIG. 4. After the photocell 54 detects that a filled bag has been loaded, the piston 70 is then actuated to move the case and position the second compartment 52' to the bag receiving position 53. The third compartment 52" is then displaced at the bag receiving position once the photocell 54 detects the loading of a filled bag in the second compartment.

Briefly summarizing the operation of the machine of the present invention, it consists of essentially positioning the case engaging and displacement mechanism 60 in the open top end of a case whereby to segment the case in compartments. The case engaging and displacement mechanism 60 is then displaced by the indexing frame assembly 64 to position the compartments, in sequence, at the bag receiving position 53. The filled bag 21" at the bag filling station 22 which is filled with small pouches of milk or other liquid, is then displaced by the transfer clamp assembly 37 axially on guide rods or rails 43 and brought between the clamping plate assembly 45 where the filled bag 21", with the unstable liquid pouches therein, is squeezed or compressed to presize it and the side transfer clamp assembly 37 is disengaged and returned to the bag filling station to engage another bag. Once positioned over the aligned compartment at the loading position 53, the plate 48 is retracted and the filled bag 21" falls within the compartment 52 between the division plates 62 and the side walls 11' of the case 11 or between two division plates 62 depending on the location of the compartment 52. All the compartments 52 are filled in sequence and the case is displaced by the case engaging frame 60 which is secured to the indexing frame. This is done by controlling the piston 70 of the indexing frame and detecting the loading of filled bags within the compartments. After the case is filled, the retracting frame 65 is moved upwardly by actuating piston 66 to release the filled case 11 which is conveyed away on its transport conveyor 67.

As previously described, the method also comprises conveying spaced apart batches of liquid pouches 12 to the control chute 24 for directing the pouches into the open top end 25 of the filled bag 21" held open under the chute. The trap wall 26 of the chute is closed after a batch 18 of pouches 12 have been directed into the open top end of the filled bag 21" whereby to accumulate the pouches 12 of the next batches 18 until the filled bag 21" has been removed from under the chute 24 and a new bag has been engaged in an open position to receive the following batch of pouches.

The pouches are released on the conveyor 14, counted and an accumulation of leading ones of the pouches of a next batch is made prior to being released on the inclined conveyor 19, whereby the batches 18 are separated from one another. The two Thimonier machines 13 automatically form, fill and seal the milk pouches 12 or pouches containing any beverage or other liquid and these are released on the conveyor 14.

It is within the ambit of the present invention to cover any obvious modifications of the preferred embodiment described herein, provided such modifications fall within the scope of the appended claims.

What is claimed is:

1. A case loading machine for positioning at least two flexible bags, having an unstable product therein, in a case and in side-by-side contact with one another; said machine comprising case engaging and displacement means having at least one rigid division wall plate positionable inside said case from an open top end of said case to divide said case into two or more compartments of predetermined size, said case engaging and displacement means holding said case at a loading position with one of said compartments aligned at a bag receiving position, bag engaging and transfer means for placing one of said bags in said one of said compartments aligned at said bag receiving position, said bag engaging and transfer means having compression means to compress said flexible bag and displace said unstable product therein whereby said bag is sized to enter into said one of said compartments, said case engaging and displacement means displacing said case to align said other of said two compartments, sequentially, at said loading position whereby each compartment receives a further bag from said bag engaging and transfer means, and means to feed another case to said case engaging and displacement means, said bag engaging and transfer means being comprised by a bag clamping and transfer mechanism for engaging a filled bag at a bag filling station and transferring said filled bag between a pair of spaced bag engaging and compression transfer plates for engaging a filled bag disposed therebetween and compressing same to size said filled bag, said transfer plates being supported on a horizontally displaceable frame to position same at a bag receiving position and a bag discharge position.

2. A case loading machine as claimed in claim 1 wherein said bag receiving position is located over a transfer conveyor, said pair of spaced bag engaging and compression transfer plates being comprised by a stationary vertical plate having an inturned lower support ledge and a displaceable vertical plate also having a lower inturned support ledge and connected to piston means for displacing said displaceable vertical plate in substantially planar parallel relationship to and away from said stationary plate from a bag receiving position to a bag holding and compressing position where said plates are spaced closer to one another to squeeze and support said bag with its unstable product therein to effectuate said sizing of said bag.

3. A case loading machine as claimed in claim 1 wherein said case engaging and displacement means is secured to a piston actuated indexing frame to position said compartment at said bag receiving position in sequence, and vertical displacement means for engaging and disengaging said case engaging and displacement means from a case.

4. A case loading machine as claimed in claim 3 wherein said vertical displacement means is a piston actuated frame which is secured to said piston activated indexing frame.

5. A case loading machine as claimed in claim 3 wherein said means to feed another case to said case engaging and displacement means comprises a case conveyor, arresting means to hold a case at a feed position adjacent said loading position, and case placement means at said loading position to retain a case in a stationary position to receive said case engaging and displacement means therein.

6. A case loading machine as claimed in claim 5 wherein said arresting means is comprised by a pair of clamps for clamping a case from opposed side walls thereof and aligning same at said feed position, said clamps releasing said case for automatic transfer to said loading position.

7. A case loading machine as claimed in claim 5 wherein said case placement means is comprised by one or more piston actuated arresting arms for arresting said case at a predetermined position aligned with said case engaging and displacement means positioned at said loading position.

8. A case loading machine as claimed in claim 3 wherein said vertical displacement means is a piston secured to said indexing frame and having a piston rod end thereof secured to said case engaging and displacement means to displace same vertically downward to engage a case positioned at said loading position and to retract said case engaging and displacement means after said compartments are loaded with said bags to release said loaded case.

9. A case loading machine as claimed in claim 8 wherein said case engaging and displacement means is a rectangular case engaging frame dimensioned to fit inside and adjacent opposed side walls of a case, said frame having opposed top parallel flange walls and two of said division wall plates equidistantly spaced from one another and from opposed flange walls, said flange walls extending above a top edge of a case engaged thereby with said division wall plates extending into said case and terminating close to a bottom wall of said case, said flange walls guiding said compressed bag into said compartments when released by said bag engaging and transfer means displaced thereover.

10. A case loading machine as claimed in claim 1 wherein at said bag filling position there is provided a bag storage means for storing a plurality of collapsed bags, bag opening and positioning means, bag loading means to insert a predetermined quantity of said unstable product in an open bag held under a control chute, and product feed means for continuously feeding said unstable products to said control chute, said control chute accumulating said unstable products during the transfer of a filled bag from said bag filling position by said bag clamping and transfer mechanism and the opening and positioning of a new bag to be filled under said chute.

11. A case loading machine as claimed in claim 10 wherein said product feed means includes counter means for counting the quantity of products disposed on said product feed means, said chute having a piston operated bottom trap wall, and synchronized control means for receiving signals from said counter means and from sensing means detecting the positioning of an open bag, said control means actuating said piston operated bottom trap wall to open said trap wall after said bag is opened and releasing accumulated products therein in said open bag, said piston operated bottom trap wall being actuated to close after a predetermined number of products have been discharged in said open bag through said chute.

12. A case loading machine as claimed in claim 11 wherein said feed conveyor is comprised of a first conveyor for receiving said products thereon, said counter means being associated with said first conveyor, a piston actuated stopper gate for separating batches of predetermined quantities of product and releasing same to a second inclined conveyor feeding spaced-apart batches of products to said chute.

13. A case loading machine as claimed in claim 10 wherein said bag clamping and transfer mechanism is comprised by a piston actuated clamp secured to an axially displaceable frame, said clamp engaging a side wall portion of said open bag from an open top end thereof and transferring same and releasing said clamp when said filled bag is disposed between said transfer plates.

14. A case loading machine as claimed in claim 13 wherein said unstable product is a liquid pouch.

* * * * *